US009870892B2

(12) United States Patent
Behling

(10) Patent No.: US 9,870,892 B2
(45) Date of Patent: Jan. 16, 2018

(54) PERIODIC MODULATION OF THE X-RAY INTENSITY

(71) Applicant: KONINKLIJKE PHILIPS N.V., Eindhoven (NL)

(72) Inventor: Rolf Karl Otto Behling, Norderstedt (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 903 days.

(21) Appl. No.: 14/360,425

(22) PCT Filed: Oct. 24, 2012

(86) PCT No.: PCT/IB2012/055841
§ 371 (c)(1),
(2) Date: May 23, 2014

(87) PCT Pub. No.: WO2013/076598
PCT Pub. Date: May 30, 2013

(65) Prior Publication Data

US 2014/0307853 A1 Oct. 16, 2014

Related U.S. Application Data

(60) Provisional application No. 61/563,157, filed on Nov. 23, 2011.

(51) Int. Cl.
*H01J 35/00* (2006.01)
*H01J 35/10* (2006.01)

(52) U.S. Cl.
CPC ..... *H01J 35/10* (2013.01); *H01J 2235/086* (2013.01)

(58) Field of Classification Search
CPC ..... H01J 2235/086; H01J 35/10
See application file for complete search history.

(56) References Cited

U.S. PATENT DOCUMENTS

| | | | |
|---|---|---|---|
| 3,940,625 | A | 2/1976 | Hounsfield |
| 4,321,471 | A | 3/1982 | Holland et al. |
| 4,675,892 | A | 6/1987 | Plessis |
| 5,907,592 | A | 5/1999 | Levinson |

(Continued)

FOREIGN PATENT DOCUMENTS

| | | | |
|---|---|---|---|
| DE | 19633860 | A1 | 2/1997 |
| JP | 58005950 | A | 1/1983 |

(Continued)

*Primary Examiner* — Dani Fox

(57) ABSTRACT

In order to provide an increased, i.e. faster, periodic modulation of X-ray intensity, an anode disk (28) for a rotating anode in an X-ray tube includes a circumferential target area (34) with a target surface area (36), a focal track center line (38), and a beam-dump surface area (40). The target surface area when hit by an electron beam generates X-rays. The beam-dump surface area when hit by an electron beam generates no useful X-rays Target portions and beam-dump portions are arranged alternatingly along the focal track center line. A focal spot is centered on the focal track center line. Structures on both sides of the focal track center line are arranged such that same radiation intensities are provided by the both sides when being hit by a homogenous electron beam.

13 Claims, 14 Drawing Sheets

(56) References Cited

U.S. PATENT DOCUMENTS

| | | | | |
|---|---|---|---|---|
| 6,341,155 | B1 | 1/2002 | Kuzniar | |
| 7,654,740 | B2 * | 2/2010 | Behling | H01J 35/10 378/125 |
| 2002/0101958 | A1 | 8/2002 | Bertsche | |
| 2006/0115050 | A1 | 6/2006 | Resnick | |
| 2010/0008470 | A1 | 1/2010 | Hauttmann et al. | |
| 2010/0020938 | A1 * | 1/2010 | Koch | H05G 1/52 378/138 |
| 2010/0172475 | A1 | 7/2010 | Behling | |

FOREIGN PATENT DOCUMENTS

| | | | |
|---|---|---|---|
| JP | 62186449 | A | 8/1987 |
| JP | 200773297 | A | 3/2007 |
| WO | 2007063479 | A1 | 6/2007 |
| WO | 2013001384 | A1 | 1/2013 |

* cited by examiner

PERIODIC MODULATION OF THE X-RAY INTENSITY

This application is a national stage application under 35 U.S.C. §371 of International Application No. PCT/IB2012/055841 filed on Oct. 24, 2012 and published in the English language on May 30, 2013 as International Publication No. WO/2013/076598, which claims priority to U.S. Application No. 61/563,157 filed on Nov. 23, 2011, the entire disclosures of which are incorporated herein by reference.

FIELD OF THE INVENTION

The present invention relates to an anode disk for a rotating anode in an X-ray tube for modulating a generated X-ray beam, an X-ray tube for generating periodic modulation of X-ray intensity, an X-ray imaging system, and a method for modulating an X-ray beam, as well as to a computer program element and a computer readable medium.

BACKGROUND OF THE INVENTION

X-ray imaging is used, for example, in CT imaging. Modulation of the radiated X-rays is provided, for example, by modulation of the electron beam, such as with deflection means, or also by providing a varying electrical energy for the generation of the electron beam. US 2010/0020938 A1 describes an anode disk with marks capable of modulating the number of stray electrons detected by a detecting unit. A pattern of marks is provided beside the desired track of the focal spot so that a corresponding pattern in the signal only occurs when the focal spot deviates from the desired track. Thus, it can be detected if the focal spot position leaves the optimum path. However, when applying X-ray radiation in CT imaging, for example it would be helpful for immediate calibration purposes of signal integrating detectors, to modulate the X-ray flux, which is emitted by the source, with at least one or more modulation periods per X-ray frame, thus, within ca. 200 microseconds. US2010/0172475 A1 describes means for dose modulation by deflection of an electron beam into a beam dump. However, the above mentioned examples for modulation of an X-ray beam do not provide a sufficiently fast periodic modulation, while the imaging capabilities of the system like e.g. the focal spot position—are fully maintained.

SUMMARY OF THE INVENTION

Thus, there may be a need to provide an increased, i.e. faster, periodic modulation of the X-ray intensity.

The object of the present invention is solved by the subject-matter of the independent claims, wherein further embodiments are incorporated in the dependent claims.

It should be noted that the following described aspects of the invention apply also for the anode disk, the X-ray tube, the X-ray imaging system, the computer program element and the computer readable medium.

According to a first aspect of the present invention, an anode disk for a rotating anode in an X-ray tube is provided, comprising a circumferential target area for modulating a generated X-ray beam, the target area comprising: a target surface area, a focal track centre line, and a beam-dump surface area. The target surface area is provided such that, when being hit by an electron beam, X-rays for X-ray imaging can be generated. The beam-dump surface area is provided such that, when being hit by an electron beam, no useful X-rays for X-ray imaging can be generated. The target surface area comprises a plurality of target portions, and the beam-dump surface area comprises a plurality of beam-dump portions. The target portions and the beam-dump portions are arranged along the focal track centre line such that a centre of a focal spot, in which X-ray radiation is generated, is located on the focal track centre line. Structures on both sides of the focal track centre line are arranged such that same radiation intensities are provided on the both sides when being hit by a homogenous electron beam. At least a part of the target surface area comprises target portions and beam-dump portions in an alternating manner in the direction of the focal track centre line.

The term "circumferential target area" relates to, for example, a linear focal track arranged in the vicinity of the outer edge of the anode disk. Besides being provided as a circular target area, it is also possible to provide the target area in form of a curved line with a number of curves along the anode's edge. Thus, the term "linear target area" could be used for a target area in a straight circular line, however, also comprising small deviations, for example by a small curved pattern with a number of waves (in a snake-like form).

During rotation, the target area, such as the linear target area, comprises a varying effective target. The centre of the focal spot remains spatially constant or e.g. in case of a snake-like focal spot track, is located on the centre line of the snake-like focal track.

For example, the tube surface area and the beam-dump surface area are arranged along the focal track centre line symmetrically with respect to the focal track centre line. The term "symmetric" refers to symmetry along a radial line. In case of a circular line, the term "symmetric" thus relates to a line perpendicular to the respective portion of the circle, i.e. the radial line. However, in case of a curved circumferential target area, for example comprising a number of wave structures, the term "symmetric" refers to a line perpendicular to the respective part of the target area, or, in other words, to a line perpendicular to a tangential line to the respective portion of the curve.

The target surface area and the beam-dump surface area may be provided as structures with edges arranged radially. Portions of the target surface area providing constant radiation intensity may be provided concentrically. Portions of the target surface area providing constant radiation intensity may also be defined by tangential boundary lines on both side of the focal track centre line, which boundary lines are provided with the same distance to the focal track centre line.

The target surface may be provided as a target plateau area, surrounded by beam-dump portions.

According to an exemplary embodiment, a continuous target centre portion is provided. The beam-dump surface area comprises a first plurality of grooves and a second plurality of grooves arranged on opposing sides of the target centre portion. Thus, the target surface area comprises a continuous target centre portion and interrupted side portions.

According to a further exemplary embodiment, along the focal track centre line, target portions and beam-dump portions are provided in an alternating manner.

The target portions and the beam-dump portions may each extend across the complete circumferential target area.

According to a further exemplary embodiment, at least a part of the target portions comprises a first number of first sub-portions and a second number of second sub-portions. The first sub-portions are provided with a first radial length, and the second sub-portions are provided with a second radial length. The first radial length is larger than the second radial length.

According to a second aspect of the present invention, an X-ray tube for generating periodic modulation of X-ray intensity is provided, comprising a cathode, an anode disk, and a tube housing with an X-ray window. The anode disk is provided as an anode disk according to one of the above mentioned examples. The cathode is configured to emit electrons as an electron beam with a focal spot towards the focal track. The beam-dumps are provided such that, in the position when being hit by the electron beam, a bottom surface of the beam-dump has no line-of-sight to the X-ray window.

According to an exemplary embodiment, focusing means are provided to shape the size and form of the focal spot.

According to a third aspect of the present invention, an X-ray imaging system is provided, comprising an X-ray source and X-ray detector. The X-ray source is provided as an X-ray source according to one of the above mentioned examples.

According to an exemplary embodiment, the phase of anode rotation is adapted to synchronization with an integration period of the X-ray detector.

According to a fourth aspect of the present invention, a method for modulating an X-ray beam is provided, comprising the following steps:

a) radiating an electron beam towards a rotating anode comprising a circumferential target area, with a target surface area, a focal track centre line, and a beam-dump surface area. The target surface area is provided such that, when being hit by an electron beam, X-rays for X-ray imaging can be generated. The beam-dump surface area is provided such that, when being hit by an electron beam, no useful X-rays for X-ray imaging can be generated. The target surface area comprises a plurality of target portions, and the beam-dump surface area comprises a plurality of beam-dump portions. The target portions and the beam-dump portions are arranged along the focal track centre line such that a centre of a focal spot, in which X-ray radiation is generated, is located on the focal track centre line. At least a part of the target surface area comprises target portions and beam-dump portions in an alternating manner in the direction of the focal track centre line; and b) rotating the anode disk and generating modulated X-ray radiation.

According to an exemplary embodiment, the electron beam is provided in step b) with at least two different beam shapes with a focal spot having a varying radial length.

According to an aspect of the present invention, the anode disk is provided with a structure on the focal track, i.e. the circumferential target area, which structure effects the generation of the X-ray beam in form of a modulation by providing portions from which no useful X-rays are radiated in combination with portions used for the generation of X-ray radiation. The structure is arranged such that the centre of gravity of the effective focal spot does not move with respect to the focal track centre line, but rather stays or remains to the focal spot centre line during rotation of the anode disk. The variation of the effective focal spot, i.e. the portion or area of the focal track actually being provided with a surface for generating useful X-ray radiation, is effected in a similar manner concerning the sides of the focal track centre line, in order to ensure that the generated X-ray beam originates from the same point, although from different sizes arranged concentrically around the centre point. In other words, it is provided that the X-ray beam does not move in terms of spatial relation with the detector, but is only modulated in terms of intensity.

These and other aspects of the invention will become apparent from and be elucidated with reference to the embodiments described hereinafter.

BRIEF DESCRIPTION OF THE DRAWINGS

Exemplary embodiments of the invention will be described in the following with reference to the following drawings.

DETAILED DESCRIPTION OF EMBODIMENTS

Figure 1:
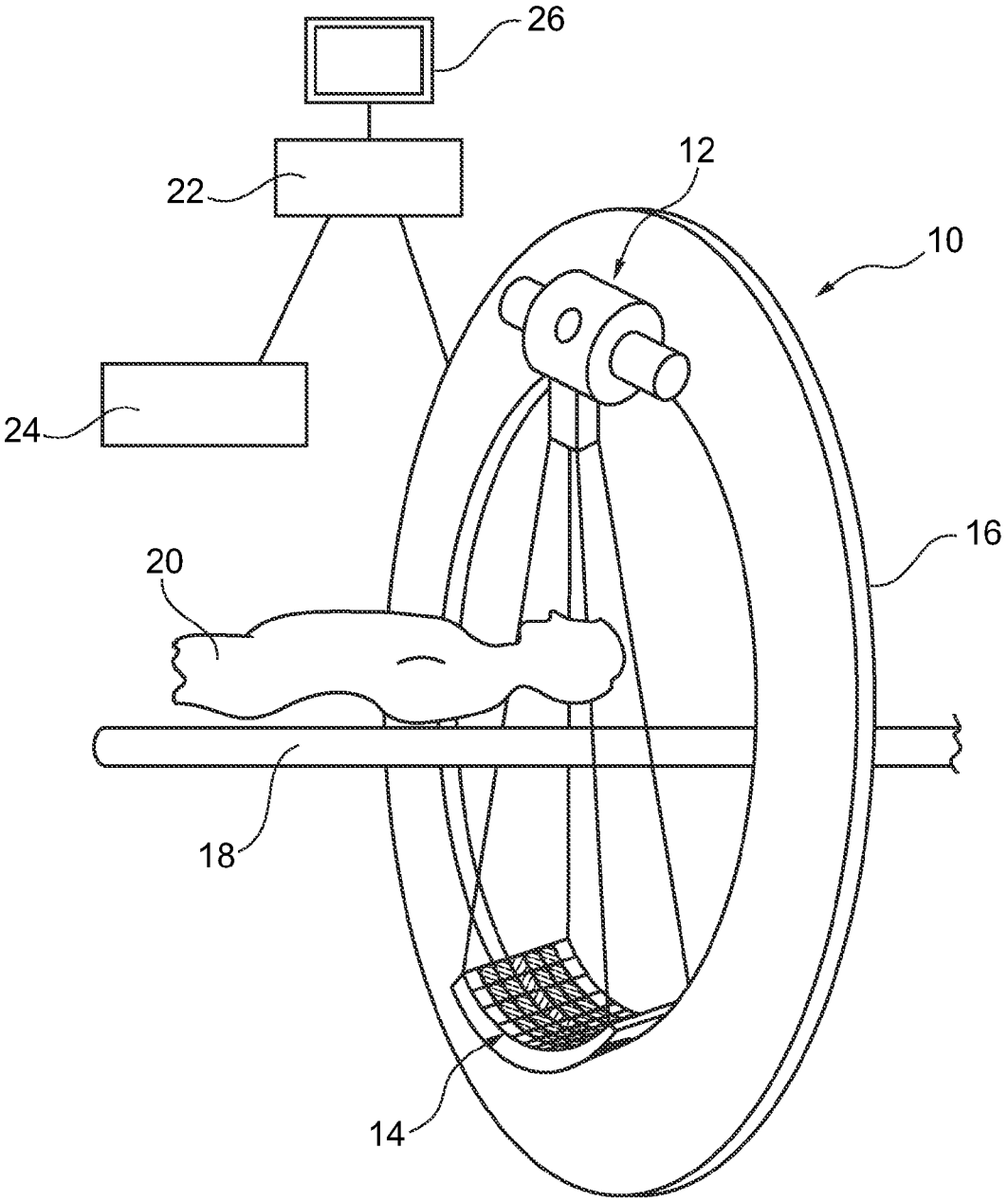
FIG. 1 shows an X-ray imaging system according to an exemplary embodiment of the present invention.

FIG. 1 shows an X-ray imaging system 10, comprising an X-ray source 12 and an X-ray detector 14. For example, the X-ray imaging system 10 is a CT imaging system, comprising a gantry 16, on which the X-ray source 12 and the X-ray detector 14 are mounted opposite to each other, and where they can be rotated on the gantry in a common movement. Further, a patient table 18 is shown, on which an object, for example a patient 20, is arranged. Still further, a processing unit 22, an interface unit 24 and a display unit 26 are provided.

It must be noted that, although FIG. 1 shows a CT system, also other X-ray imaging systems are provided by the present invention, for example a C-arm imaging system.

The X-ray source 12 is provided as an X-ray source according to one of the below described embodiments of an X-ray source.

Figure 2:
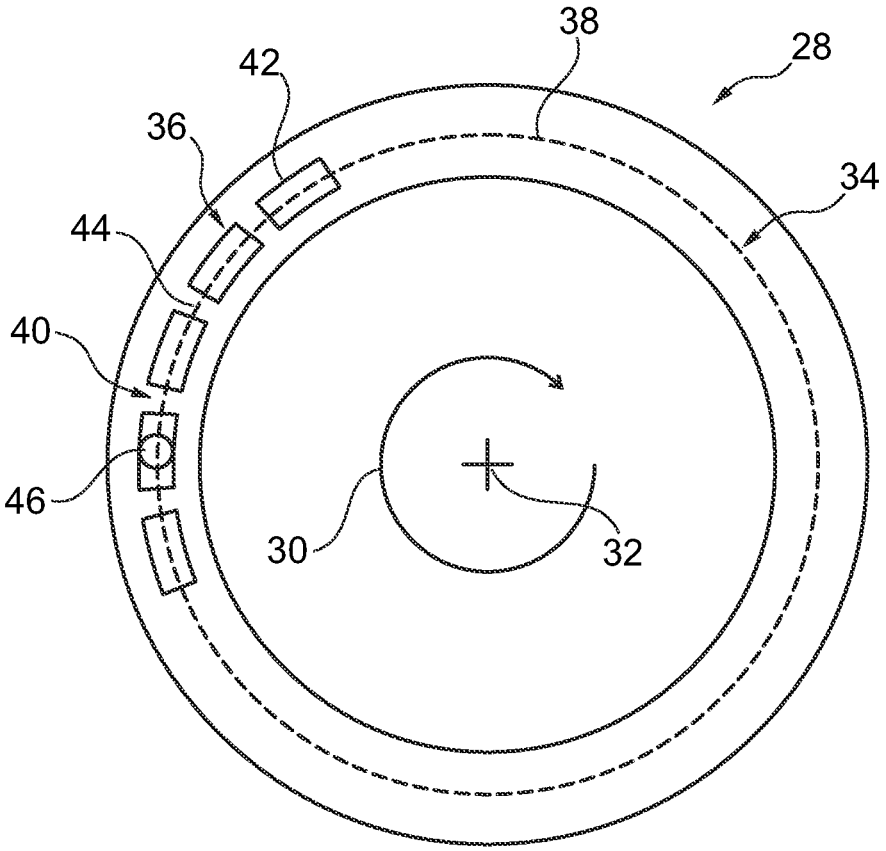
FIG. 2 schematically shows an anode disk according to an exemplary embodiment of the present invention in a top view.
Figure 7:
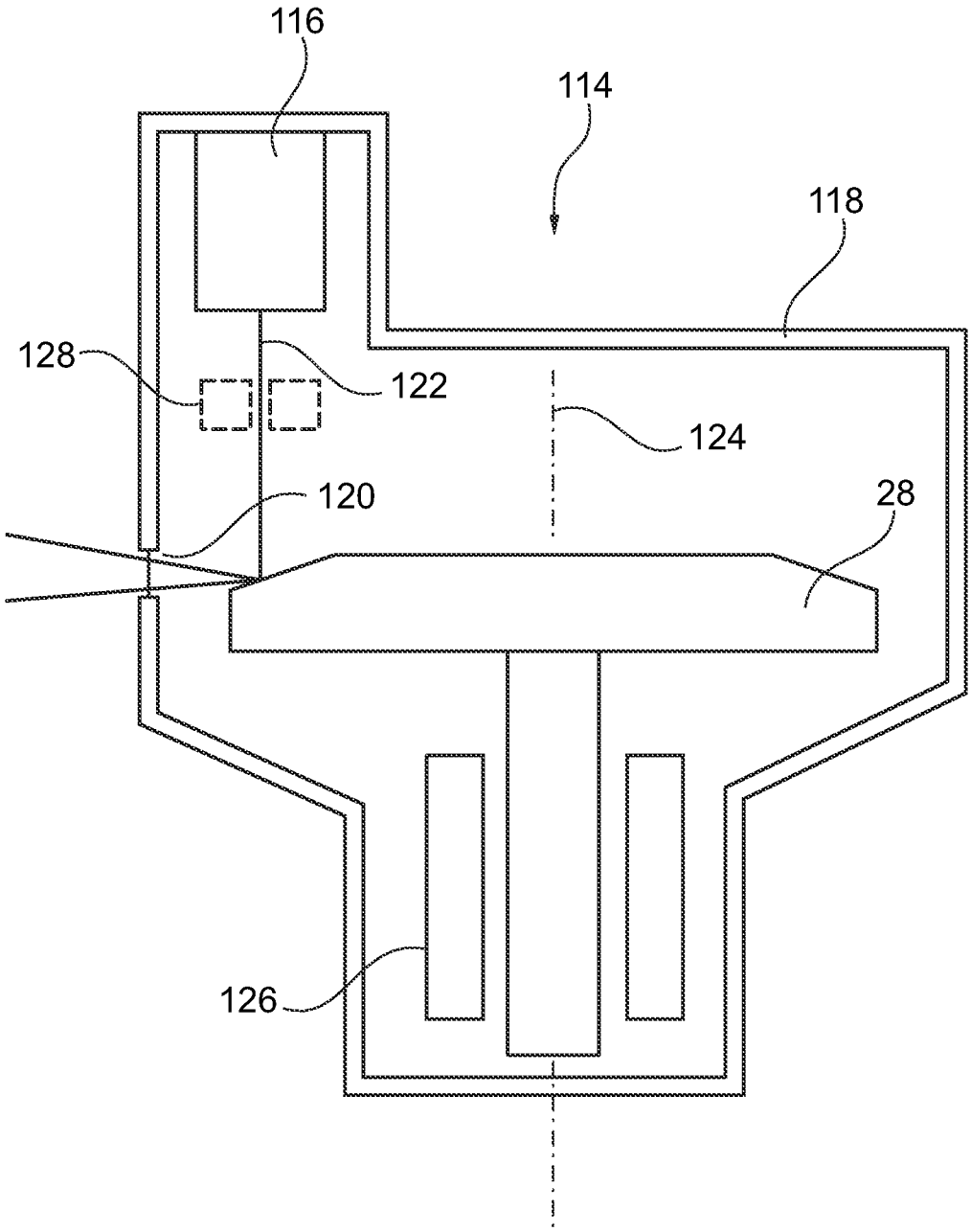
FIG. 7 shows an example of an X-ray tube according to the present invention.

Before describing the X-ray source 12 in form of an X-ray tube, shown in a cross-section in FIG. 7 for example, it is referred to FIG. 2 et seq., showing an anode disk 28 for a rotating anode in the X-ray tube. The provision for a rotation is indicated with a rotational arrow 30 around a centre point 32.

The anode disk 28 comprises a circumferential target area 34 for modulating the generated X-ray beam, for example as a circumferential linear target area. The target area 34 comprises a target surface area 36, a focal track centre line 38, and a beam-dump surface area 40.

The target surface area 36 is provided such that, when being hit by an electron beam, X-rays for X-ray imaging can be generated, which will be explained further below. The beam-dump surface area is provided such that, when being hit by an electron beam, no useful X-rays for X-ray imaging can be generated. The target surface area comprises a plurality of target portions 42, and the beam-dump surface area comprises a plurality of beam-dump portions 44.

It is noted that FIG. 2 shows a particular arrangement of the target portions 42 and the beam-dump portions 44. However, also other arrangements may be provided, such as shown in the following figures.

The target portions 42 and the beam-dump portions 44 are arranged along the focal track centre line such that a centre of a focal spot, in which X-ray radiation is generated, is located on the focal track centre line. Structures on both sides of the focal track centre line are arranged such that same radiation intensities are provided on the both sides when being hit by a homogenous electron beam. For example, a circle 46 indicates the location of a focal spot in FIG. 2, although the position of the focal spot can only be determined in combination with a cathode, which is explained with reference to FIG. 7

At least a part of the target surface area 36 comprises target portions 42 and beam-dump portions 44 in an alternating manner in the direction of the focal track centre line 38.

FIG. 2 shows the focal track centre line 38 as a linear circumferential, i.e. circular structure. However, also curved focal track centre lines are provided, or also curved circumferential target areas arranged on the anode disk 28.

During rotation, the target area 34 comprises a varying effective target. The centre of the focal spot remains spatially constant.

Thus, FIG. 2 provides a modulation between 100% and 0%. A modulation between 100% and 0% may theoretically provided by switching of the electron beam as an alternative method. However, the modulation according to the present invention provides the advantage that during the transition from 100% to 0%, the focal spot is not deformed as is the case with switching the electron beam.

It is further noted that other modulations are also provided according to further examples of the present invention.

Figure 3:
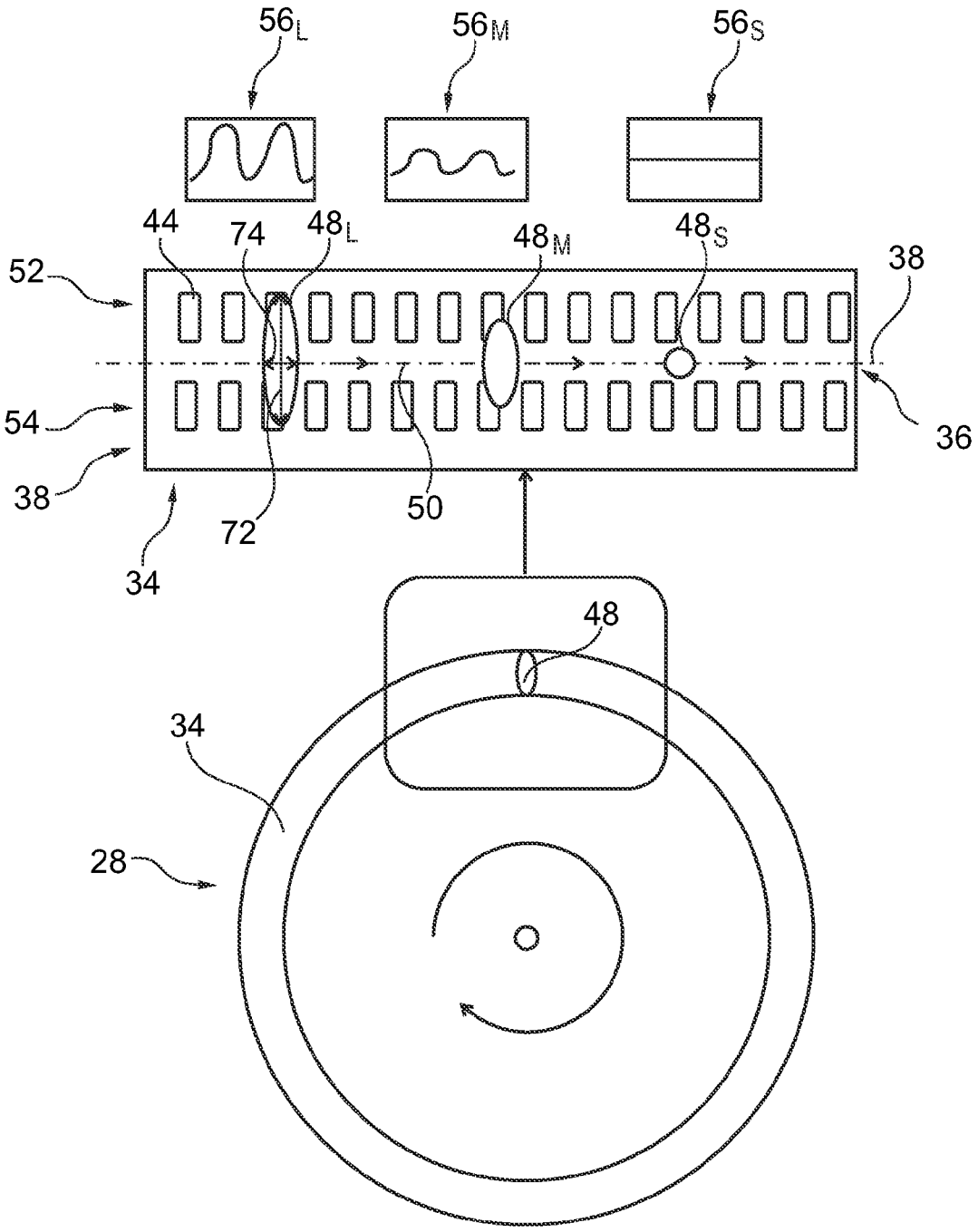
FIG. 3 shows a further example of an anode disk according to the present invention in a top view.

FIG. 3 shows a further example of the anode disk 28 with the target area 34. An elliptic structure 48 indicates a focal spot position. The target area 34 is shown in a linear manner above the anode disk 28, wherein instead of the circumferential arrangement and the respective alignments of the beam-dump portions 44, for example to the centre of the anode disk, the beam-dump portions are provided in a straightened linear configuration. However, a skilled person understands that this linear projection provided for explanation of purposes only.

The target surface area 36 and the beam-dump surface area 38 are arranged along the focal track centre line, indicated with a dotted line 38, symmetrically with respect to the focal track centre line 38. The term "symmetric" refers to a symmetry on a radial line, where the crossing point with the focal track centre line is the mirror, or symmetry axis. Because of the curved focal track (being circumferential), no real symmetry is of course provided here over a length of the focal track, but only for the point on the focal track having symmetric beam generating portions. The target surface area and the beam-dump surface area, i.e. the target portions 42 and the beam-dump portions 44, are provided as structures with edges arranged radially, which are shown to be parallel to each other with the linear projection in FIG. 3.

For example, a continuous target centre portion 50 is provided, as shown in FIG. 3. The beam-dump surface area comprises a first plurality 52 of grooves and a second plurality 54 of grooves arranged on opposing sides of the target centre portion 50. As shown, the grooves are provided on the inner side and on the outer side of the focal track centre line 38. Hence, next to the continuous target centre portion 50, interrupted side portions are provided.

With respect to the focal spot 48, this is shown as three different exemplary configurations in FIG. 3 in the linear projection, thus indicated with reference numerals $\mathbf{48}_L$ for a large focal spot size, $\mathbf{48}_M$ for a medium size of focal spot, and $\mathbf{48}_S$ for a small focal spot. The different focal spot sizes are shown in combination, although they are provided at the same position with respect to the focal track centre line 38. Their separation is only provided for explanatory reasons. Above the linear projection of the circumferential target area 34, a respective icon-like diagram $\mathbf{56}_L$, $\mathbf{56}_M$, and $\mathbf{56}_S$ shows the respective resulting beam modulation. As shown, because the large focal spot $\mathbf{48}_L$ extends across both groove patterns, an intensive beam modulation is provided. Because the medium-sized focal spot $\mathbf{48}_M$ has a larger percentage of an unaffected portion, i.e. the continuous target centre portion 50, a modulation is less than compared with the large focal spot $\mathbf{48}_L$. Because the small focal spot only covers the continuous target centre portion 50, no modulation occurs.

Figure 4:
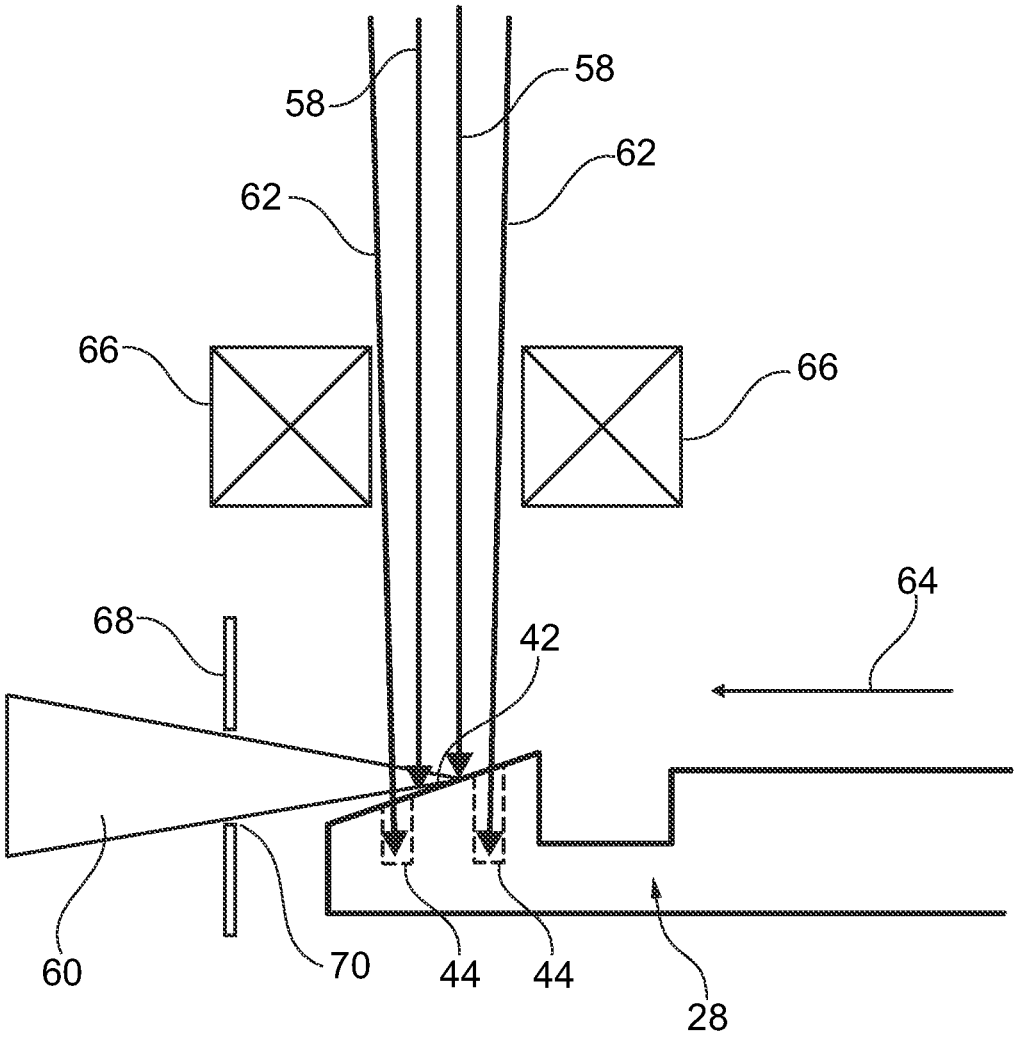
FIG. 4 shows a cross-section of the anode disk according to FIG. 3.

FIG. 4 shows a cross-section through the anode disk 28, where two arrows 58 indicate the parts of the X-rays used for generating an X-ray beam 60 by hitting the target portion 42. Two further arrows 62 indicate X-rays hitting the beam-dump portions 44, the latter indicated with a dotted line. Further, an arrow 64 indicates the radial direction.

Although belonging to the structure of an X-ray tube, deflection means 66 and a portion of an X-ray tube housing 68, as well as an X-ray window 70 are shown.

For example, the beam deflection means 66 may be provided as magnetic focusing or capacitive focusing. The modulation amplitude, as shown in FIG. 3, can be adjusted by adjusting the focal spot length. Adjustment of the focal spot width may be used to adjust the transition time between levels of the modulation. The focal spot length is indicated with a first double arrow 72, also referred to as $F_L$. the focal spot width is indicated with a second double arrow 74 in FIG. 3, also referred to as $F_W$.

As an example only, the anode may spin with 180 Hz, and the track diameter is 180 mm; the track speed is then 102 m/s.

When taking a focal track of 100 m/s, a groove pitch of 1 mm period will provide a 100 kHz modulation. Thus, "integration periods" are larger than 100 msec long. The grooves may be provided with 0.5 mm pitch with 1 mm period, and the focal spot width may be sufficiently small, for example smaller than 0.5 mm.

According to a further example, the target portions 42 are provided with different radial widths 76, also referred to as $R_W$. The target portions 42 may also be provided, alternatively or additionally, with different radial lengths 78, referred to as $R_L$. The term "radial width" relates to a dimension of a portion in the radial direction, and the term "radial length" relates to a dimension of the portion in direction of the focal track centre line.

Figure 5A:
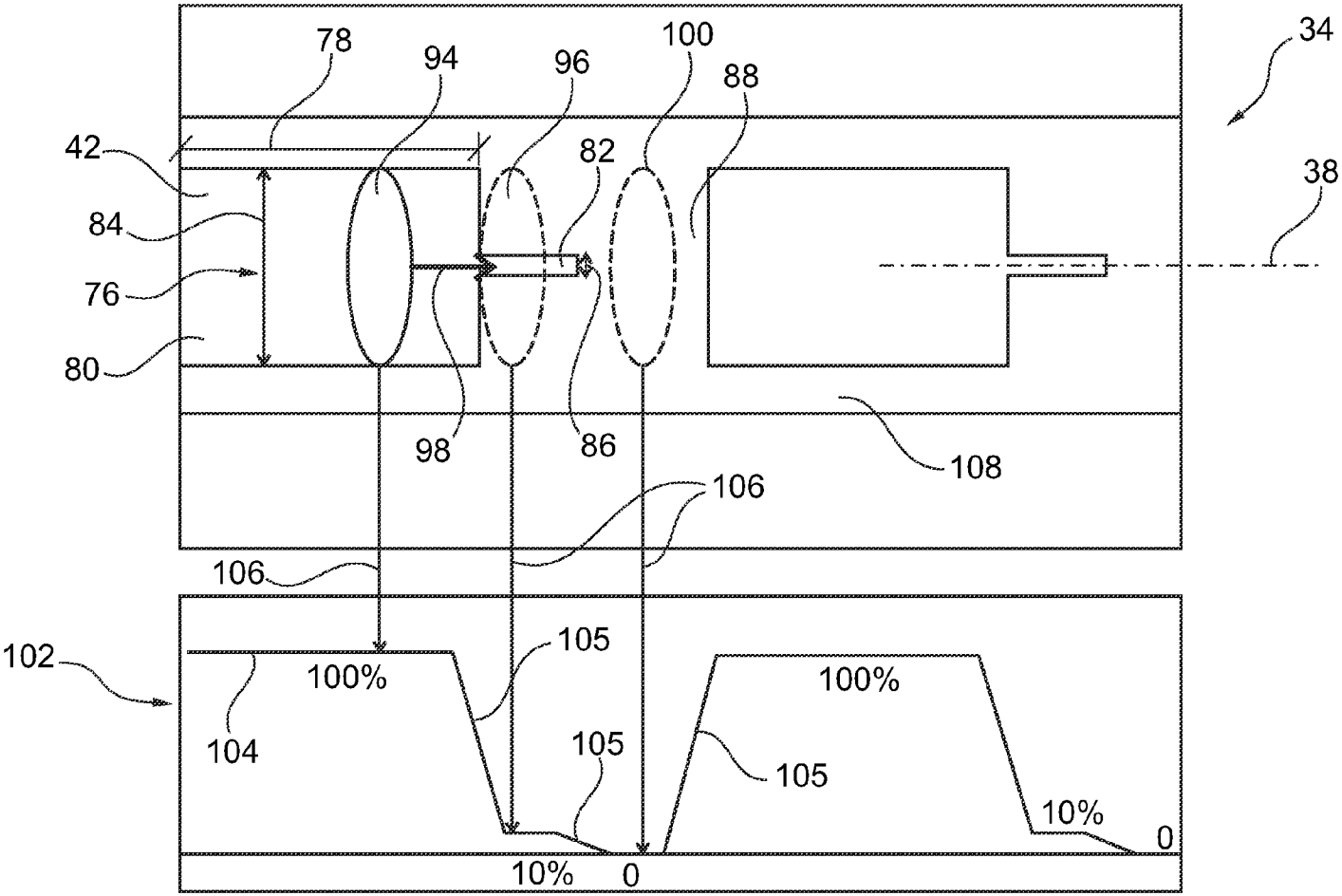
FIGS. 5*a* and 5*b* show a further example of an anode disk according to the present invention in a detailed top view (section only in FIG. 5*a*) and a top view (FIG. 5*b*).

For example, FIG. 5*a* shows a further linear projection of the circumferential target area 34. Instead of a continuous target centre portion, at least a part of the target portions comprises a first number of first sub-portions 80 and second number of second sub-portions 82. The first sub-portions 80 are provided with a first radial length 84, and the second sub-portions are provided with a second radial length 86. The first radial length 84 is larger than the second radial length 86.

As indicated above in relation with FIG. 2, the modulation according to the present invention provides the advantage that during the transition, the focal spot is not deformed. Thus, a stable intensity value of 10% is achieved. It is noted that such stable "intermediate" value of 10% is hardly achievable with electron beam switching.

Figure 5B:
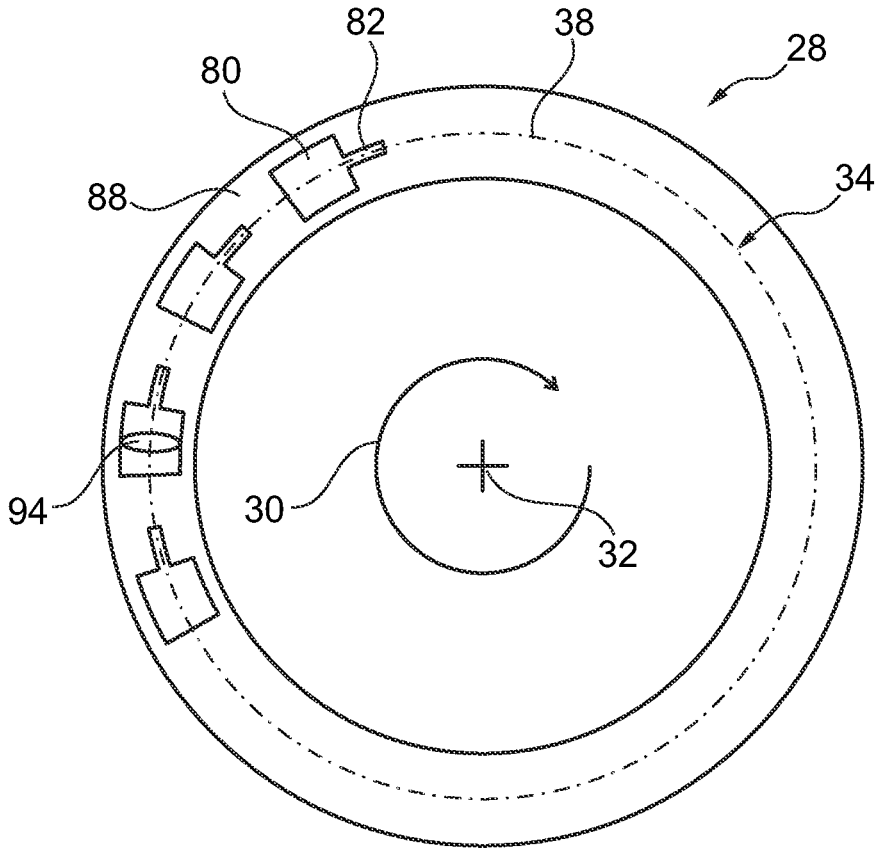

FIG. 5*b* shows a top view of an anode with the arrangement of the target portions of FIG. 5*a* comprising the first and second sub-portions 80, 82. The focal spot position is indicated with reference numeral 94 only for the sake of simplicity. Of course, the features described in relation with FIG. 5*a* are also provided for FIG. 5*b*.

According to a further example (although not shown), a third, or further, plurality of third, or further, sub-portions is provided.

For example, as shown in FIG. 5*a* (and FIG. 5*b*), a target pattern is provided, with a first sub-portion and a second sub-portion provided adjacent along the focal track centre line followed by a beam-dump sub-portion 88.

Figure 6:
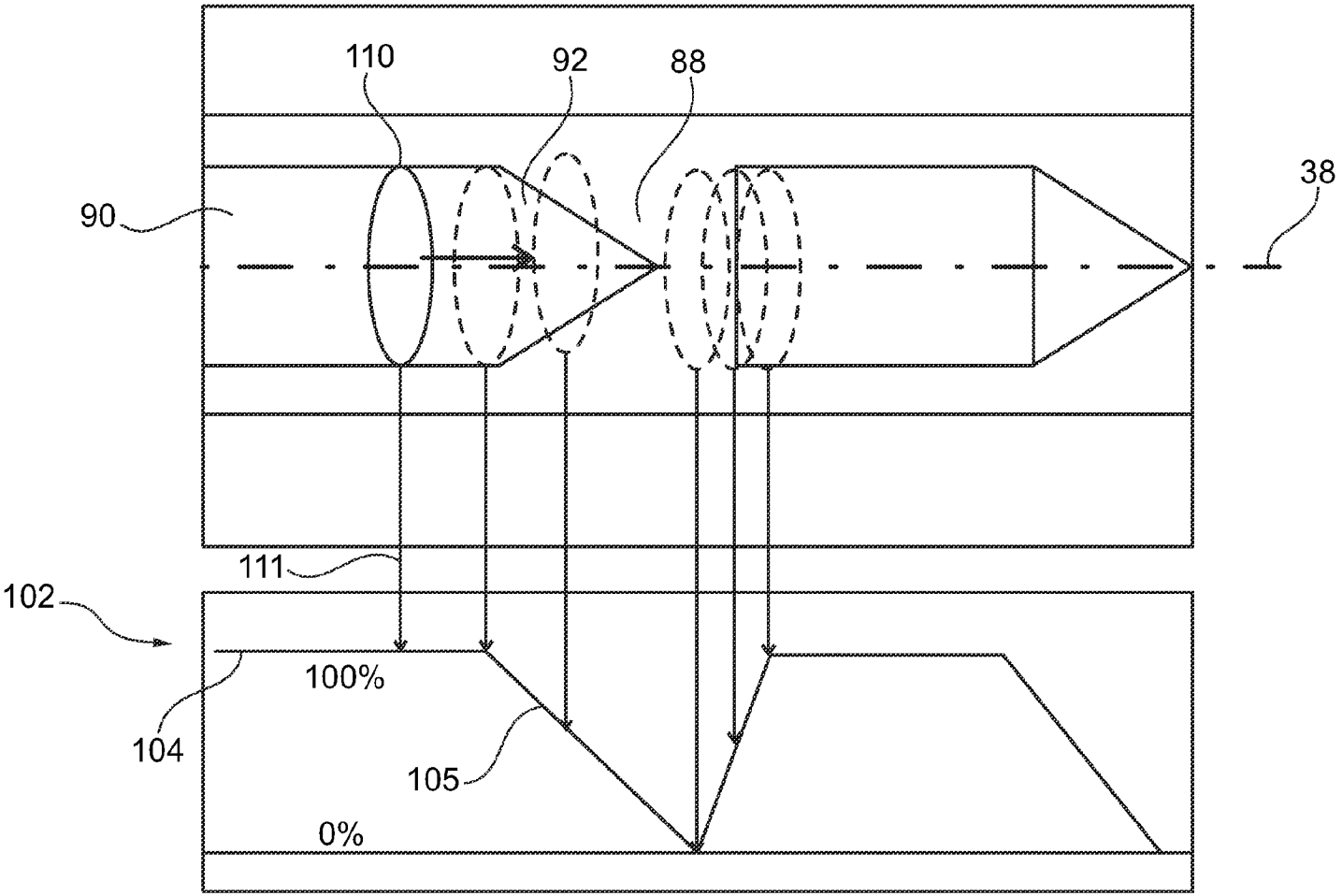
FIG. 6 shows a further example of an anode disk according to the present invention in a detailed view in a top view (section only).

The first sub-portions 80 may be provided as target plateaus 90. The second sub-portions 82 may be provided as transition plateaus 92 adjacent to the first sub-portions 80. The transition portions have a decreasing radial width from the first sub-portion to the beam-dump portion, as shown in FIG. 6. For example, in a moving direction of the focal spot, the second sub-portions are provided with a decreasing radial width followed by a beam-dump sub-portion. The second sub-portions are provided with an essentially triangular shape, wherein the triangular shape is adapted to the circularity of the focal track centre line.

The second sub-portions may also be provided with a centre symmetric shape, such as hyperbolic, stepped or triangular.

By implying plateaus of the focal spot track and beam-dumps, the generated used photon flux is periodically modulated.

With respect to FIG. 5*a*, FIG. 5*b*, and also FIG. 6, a triple level flux modulation may be provided. For example, FIG. 5 (FIG. 5*a* and FIG. 5*b*) shows a 100%/10%/0% flux modulation.

For example, the first sub-portions 80 are "100%-plateaus", fully accommodating the electron beam, as indicated with an elliptic focal spot indicator 94. The second sub-portions 82 as "10%-plateaus" generate only 10% of the full photon flux, because the electron beam covers also portions of the so-to-speak plateau-dump, i.e. the dump sub-portion 88 surrounding the second sub-portion 82. As indicated with a further focal spot indicator 96, upon movement of the anode disk, indicated with moving arrow 98, this position of the focal spot with relation to the 10% plateau is shown. Upon further movement, indicated with a further focal spot indicator 100, a so-to-speak 0%-plateaus, or dump, is provided, in which the electron beam is completely dumped, and thus no photon flux is generated here.

For a better explanation, a diagram 102 is shown beneath the target area 34 indicating the respective photon flux with a curve 104. Connection arrows 106 indicate the respective position on the target area 34 of the focal spot position and the related generated photon flux modulation.

It is noted that, because of the elliptical shape of the focal spot, transition portions 106 of the curve 104 occur between the 100%-level and the 10%-level as well as the 0%-level, and from the 0%-level also to the 100%-level, again. Thus, a stepwise periodic modulation, for example with the period of a short CT frame is provided.

According to a further exemplary feature, the portion around the 100% plateaus, i.e. for example the first sub-portions 80, may also be provided as a surrounding or carved-out beam-dump portion 108.

FIG. 6 shows the example with the transition portions 92 and the resulting photon flux modulation also in a diagram below. Further, a plurality of focal spot positions 110 is indicated, also combined with connecting arrows 111 referring to the respective point on the curve 104.

By employing various shapes of the plateaus, the temporal profiles of the X-ray flux can be shaped in a flexible way. The transition plateaus may, for example, be of a so-to-speak triangular shape, as shown.

Figure 9:
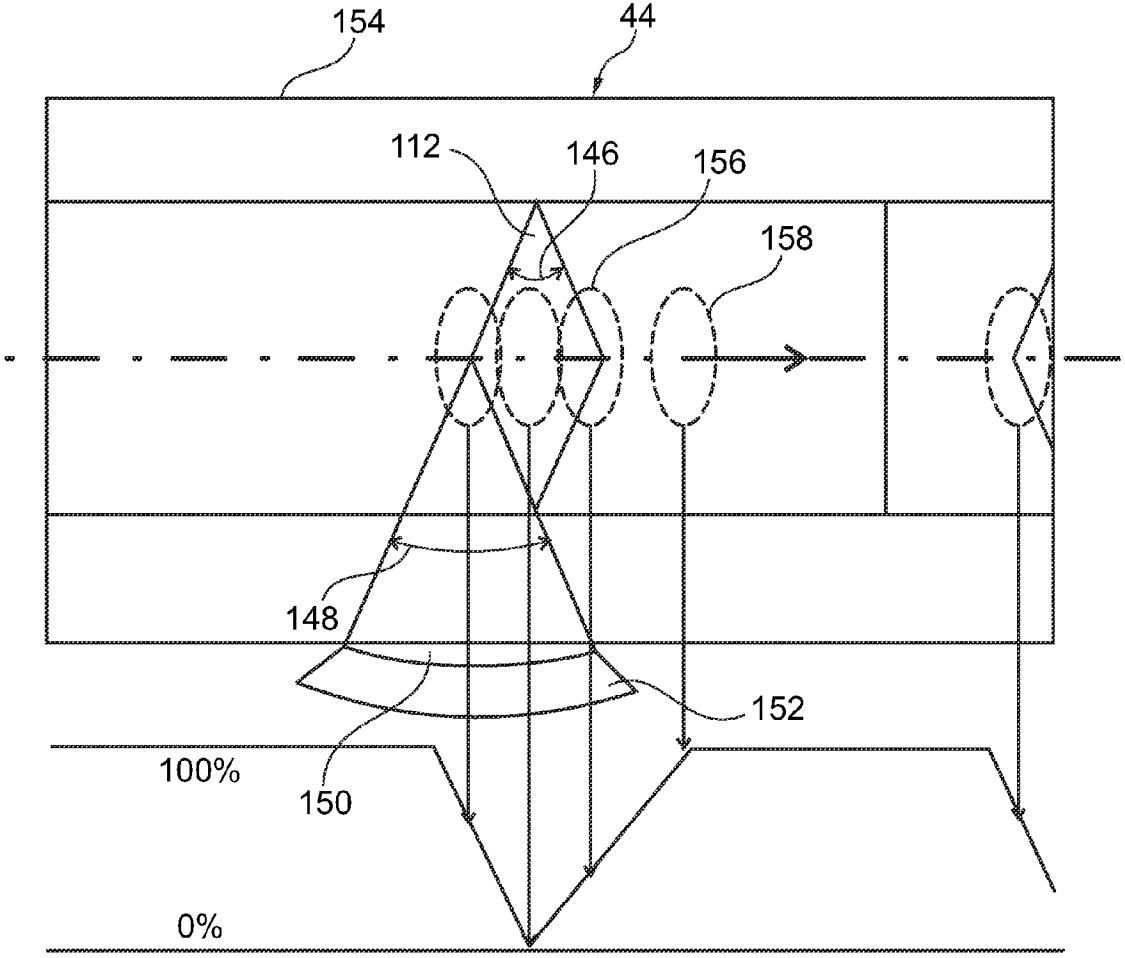
FIG. 9 shows a further example of an anode disk according to the present invention in a detailed top view (section only).

According to a further example, shown in FIG. 9, in a moving direction of the focal spot, the beam-dump portions 44 may be provided with an increasing and then decreasing radial width. For example, as shown in FIG. 9, the beam-dump portions are provided as rhomboidal beam-dumps 112.

Before explaining further features shown in FIG. 9, it is referred to FIG. 7, showing an X-ray tube 114 for generating periodic modulation of X-ray intensity according to the present invention. The X-ray 114 comprises a cathode 116, the anode disk 28 according to one of the above and below described examples, and a tube housing 118 with an X-ray window 120.

The cathode 116 is configured to emit electrons as an electron beam 122 with a focal spot towards the focal track. The beam-dumps, not further shown in FIG. 7, are provided such that, in the position when being hit by the electron beam, a bottom surface of the beam-dump has no line-of-sight to the X-ray window 120.

The rotation of the anode disk is indicated with a rotational axis 124. Further, bearing and driving means 126 are shown only very schematically. As a further option, focusing means 128 are provided to shape the size and form of the electron beam, i.e. the focal spot. For example, the focusing means are magnetic focusing means. The electron beam may thus be deflectable in a tangential direction. The focal spot has at least an adaptable size in radial direction of the anode disk according to a further example. Alternatively, or additionally, the focal spot has at least an adaptable size in the tangential direction of the anode disk.

Figure 8:
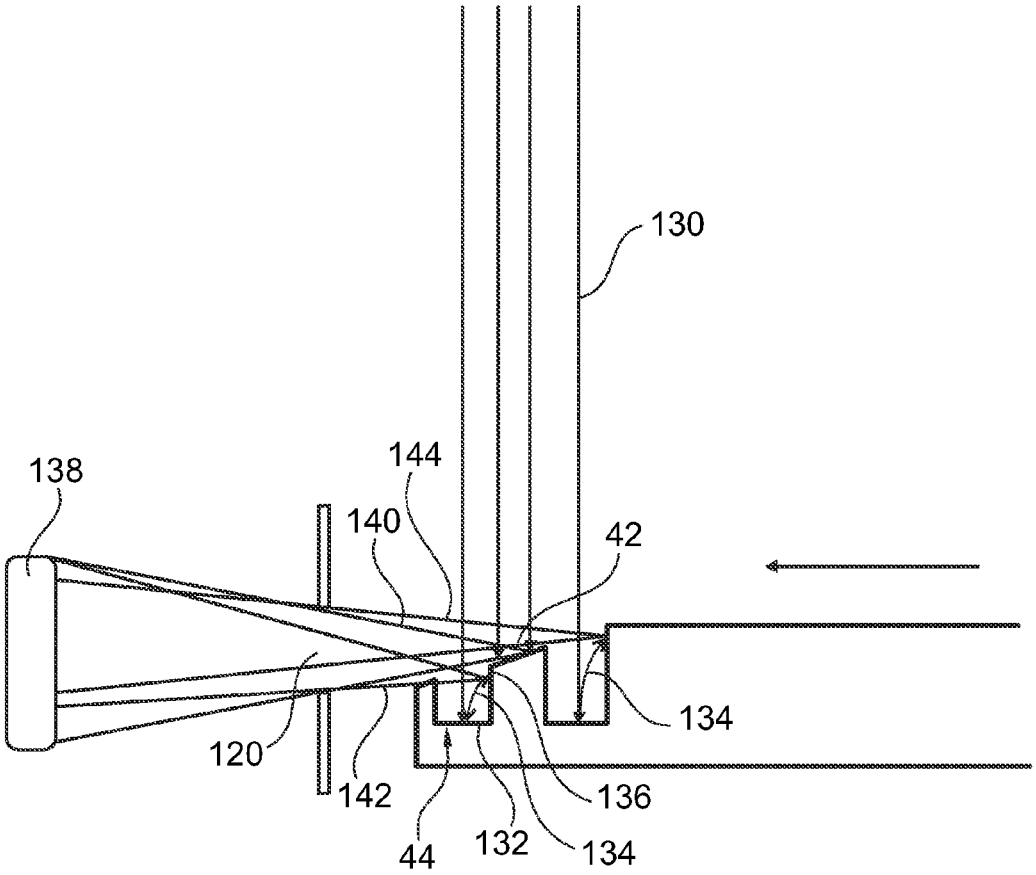
FIG. 8 shows a further example of an X-ray tube with an anode disk according to the present invention in a vertical cross-section.

FIG. 8 schematically shows the function of the beam-dumps, i.e. the beam-dump portions 44. Vertical arrows 130 indicate possible electron beams segments, or a large electron beam, hitting a bottom surface 132 of the beam-dump portion 44. From the bottom surface 132, no line-of-sight to the X-ray window 120 is provided. However, some back-scattered electrons, indicated with a small curved arrow 134 may hit sidewall portions 136 of the beam-dump portions. Further, a detector 138 is schematically shown in FIG. 8, although, of course, not representing an arrangement in scale. However, some detector cells may have a line-of-sight to the rim, or side portion wall of the beam-dump. Thus, these cells may see off-focal radiation. This is indicated by a first X-ray beam fan structure 140 indicating the generated X-ray beam, generated from the target portion 42 arranged between the two beam-dump portions 44. A second fan structure 142 indicates a possible X-ray beam generated by backscattered electrons. Further, similar is shown for the other beam-dump portion, thus providing a possible third fan beam structure 144.

This could be avoided, for example, by properly shaping the beam-dump, for example confined structures and the like, or this effect can be minimized, which is shown as an example with reference to FIG. 9.

As shown in FIG. 9, beam-dump portions having an increasing and decreasing radial width are provided with two sides forming a radially outwards oriented opening angle 146, which opening angle is larger than a fan angle 148 of an X-ray beam 150 radiated through the X-ray window (not shown in FIG. 9). However, a detector 152 is schematically shown.

In order to avoid the problems relating to the backscattered electrons, the respective sidewall portions 154 and 156 of the rhombus angle may be provided with low-Z material to avoid off-focal radiation from the backscattered electrons. Of course, the provision of low-z material, to avoid backscattered radiation, may also be provided to other forms and shapes of beam-dump portions.

With respect to FIG. 9, a number of focal spot positions are indicated with further elliptic structures 158. As mentioned above, the positions, i.e. structures, indicate the position with respect to the centre line caused by a rotational movement of the anode disk.

As indicated above, even with perpendicular impact of primary electrons, rims of the transition plateaus may be hit by electrons, which are backscattered from the bottom of the beam-dump. To minimize this off-focal radiation and illumination of the X-tray detector in an asymmetric way, the profiles of the transition plateaus may be "confined", for example of rhomboidal shape, such that only a few detector cells are in line-of-sight of such rims. However, due to the non-zero anode angle, there may be still some detector cells in line-of-sight.

The rhombus angle should be larger than the detector fan angle.

Other confined shapes can be used to modulate the beam flux in a different way as long as they comply with the upper requirement.

During transition and for low flux, the focal spot will be split in two parts in length direction, according to a further example. As long as the overall length is sufficiently small, this should not jeopardize the imaging performance of the system.

Figure 10:
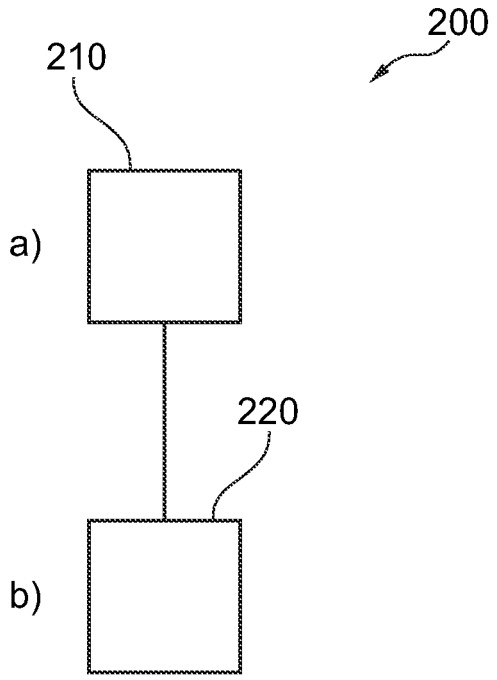
FIG. 10 shows basic steps of a method for modulating an X-ray beam according to the present invention.

FIG. 10 shows a method 200 for modulating an X-ray beam, comprising the following steps: In a first step 210, also referred to as step a), an electron beam is radiated towards a rotating anode comprising a circumferential target area, with a target surface, a focal track centre line, and a beam-dump surface. The target surface is provided such that, when being hit by an electron beam, X-rays for X-ray imaging can be generated. The beam-dump surface is provided such that, when being hit by an electron beam, no useful X-rays for X-ray imaging can be generated. The target surface area comprises a plurality of target portions, and the beam-dump surface area comprises a plurality of beam-dump portions. The target portions and the beam-dump portions are arranged along the focal track centre line such that a centre of a focal spot, in which X-ray radiation is generated, is located on the focal track centre line. At least a part of the target surface area comprises target portions and beam-dump portions in an alternating manner in the direction of the focal track centre line. In a second step 220, also referred to as step b), the anode disk is rotated and modulated X-ray radiation is generated. The steps a) and b) are thus performed simultaneously.

Figure 11:
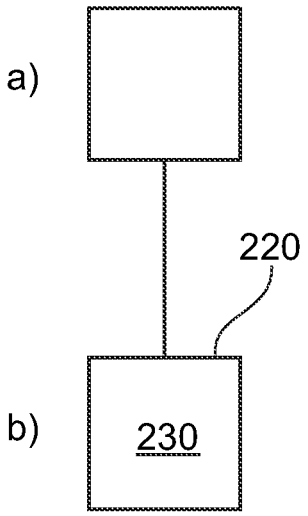
FIG. 11 shows a further example of a method according to the present invention.

According to a further example, shown in FIG. 11, during step b), the electron beam is provided with at least two different beam shapes with a focal spot having a varying radial length, indicated with reference numeral 230.

According to a further example (not shown), deflection of the electron beam in tangential direction, i.e. in x-direction, is provided to speed up the transition, for example when going from zero flux to full flux.

It is also possible to provide a combination with grid switch.

According to a further example, the phase of anode rotation is adapted to synchronization with an integration period of a detector.

Flux patterns may be different for different CT views. The reconstruction algorithm would have to align the different quality of the different views.

It is further provided to have an anode disk with separate "undisturbed" focal tracks without beam-dumps, selectable by deflection of the electron beam.

Figure 12:
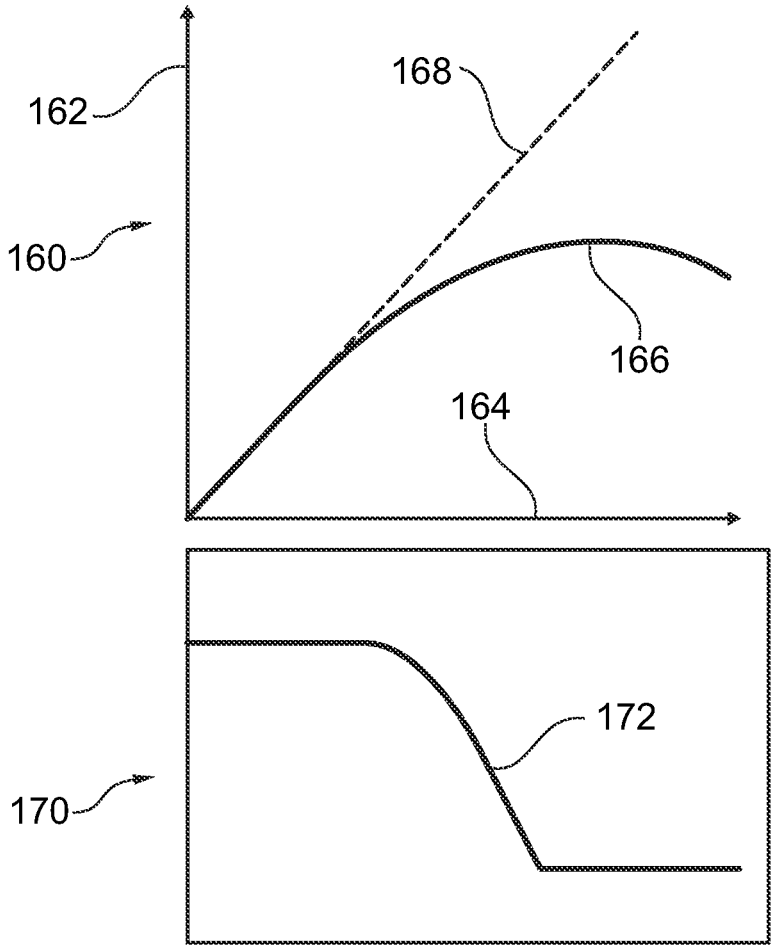
FIG. 12 shows two diagrams in relation with non-linearities of a detector according to an exemplary embodiment of the present invention.
Figure 13:
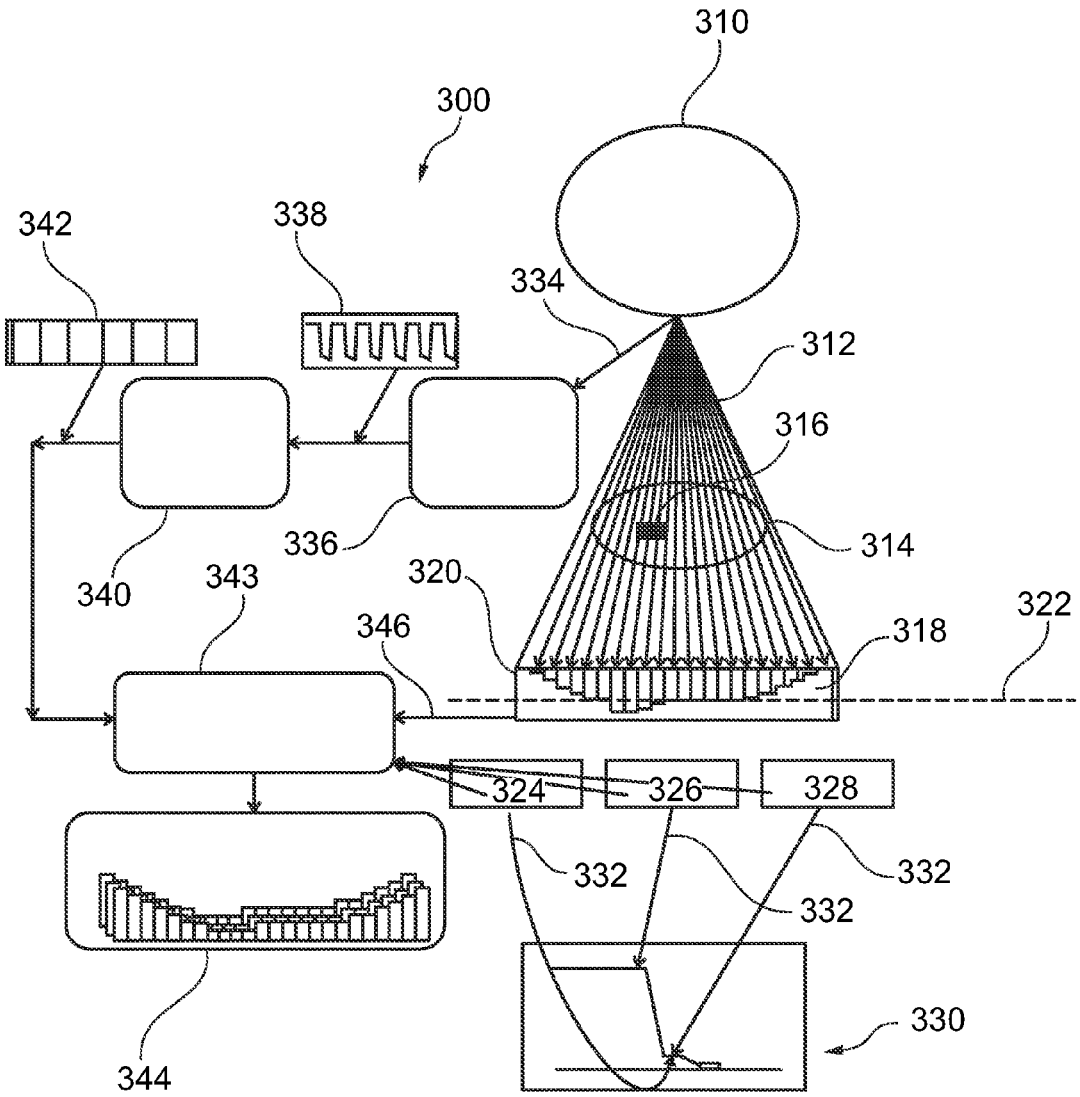
FIG. 13 shows a diagram for the measurement of photon flux, synchronization and data processing according to the present invention.
Figure 14:
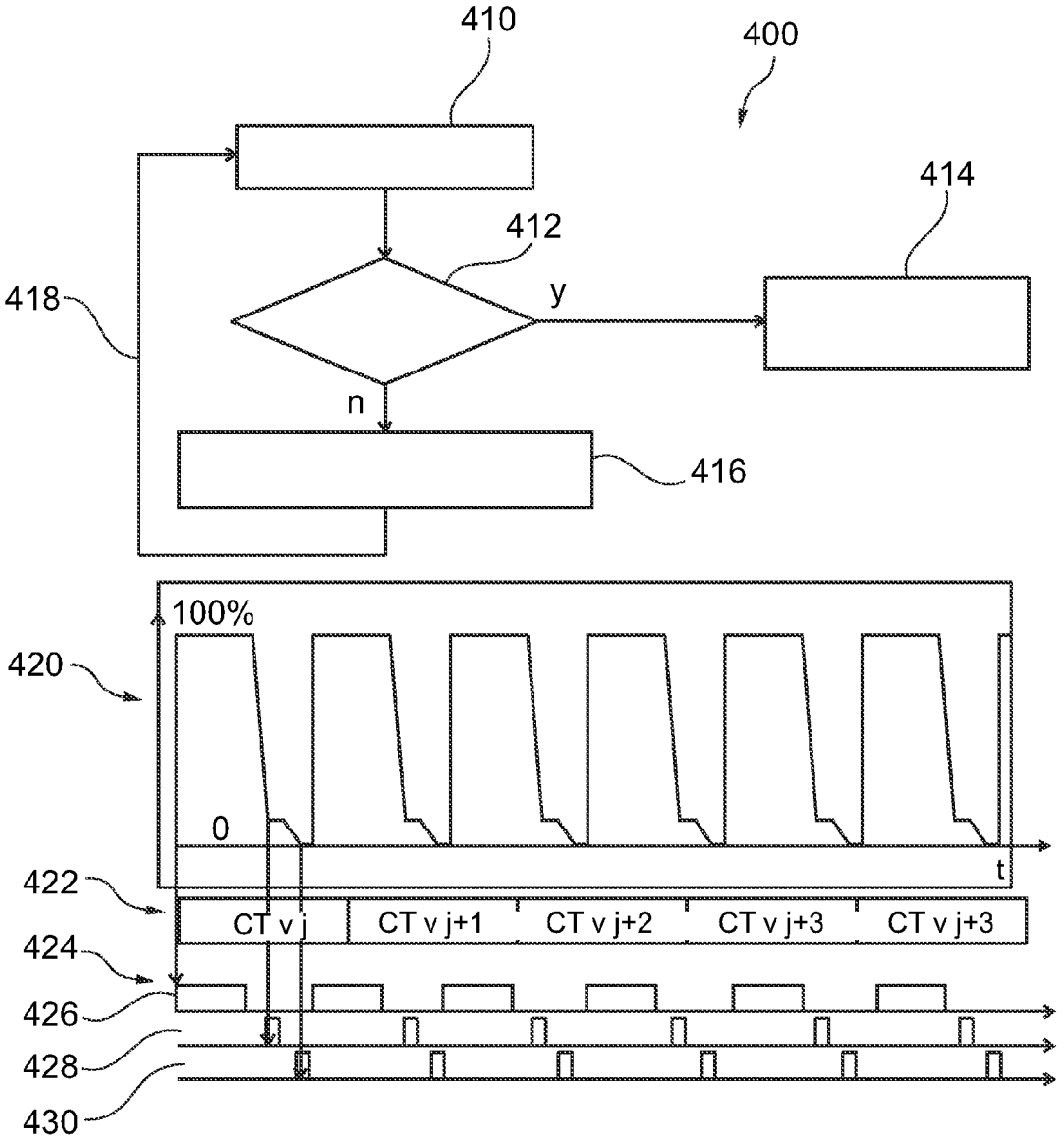
FIG. 14 shows a diagram for selecting the period of photon detection according to the present invention.

Before referring to FIGS. 13 and 14 describing measurement of photon flux and selection of period of photon detection, it is referred to FIG. 12 showing a first diagram 160 relating to detector reading 162 in the vertical axis and primary X-ray flux 164 on the horizontal axis. As shown, a detector used for CT is severely limited by the non-linearity indicated with a first curve 166 at high photon flux. A straight line in dotted manner 168 indicates the virtual linear response.

As shown in a second diagram 170 below, according to the present invention, an energy separation curve 172 is provided to avoid saturation, for example by integrating the signal only during periods of reduced photon flux, and discarding signals from periods of excessive flux.

FIG. 13 shows the measurement of photon flux, synchronization and data processing in a third diagram 300. An X-ray tube 310 provides a primary X-ray fan beam 312. An object 314 is arranged in the X-ray fan beam 312, having an X-ray opaque sub-object 316. Further, a detector array 318 is indicated with the respective indicated signal 320. A dotted line 322 indicates a marginal line, above which a non-linear response is provided, and below which a sufficient linear response is provided. Thus, the signal 320 may be divided into three portions 324, 326, and 328. The first portion 324 relates to the portion where a signal can be taken from low flux period. The second portion 326 can thus be used to take signal from high flux period. The third portion 328 can thus also be used, similar to the portion 324, to take signal from low flux period. The respective portions of the diagram of photon flux are indicated below with a sub-diagram 330 and respective connecting arrows 332.

Further, a reference beam 334 is provided to a primary flux monitor 336. The respective signal is indicated with a diagram 338. Thus, a synchronization signal 340 is provided, having signal structure 342. As a further step, gated signal processing 343 is arranged in order to arrive at a true sinogram per energy bin 334 by a combination of the synchronization signal 340 and the respective signal 310 provided, as indicated with arrow 346. Each detector pixel is read out only during suitable periods of the X-ray signal. The proper period is retrospectively determined at the end of a projection frame, which is also referred to as "integration period". The zero flux period is used for detection of crystal polarization. As the length of the modulation period is smaller than the smallest "integration period", the proper timing can be determined individually for each projection.

FIG. 14 shows a selection of the period of photon detection in a fourth diagram 400. In a first step 410, photon signals are integrated. Next, the signal is assessed in a further step 412 as being below a determined limit. If the answer is "yes", it is provided in a further step 414 to evaluate the signal, e.g. per energy. If the answer is "no", a further step 416 is provided in which the result is ignored and a low flux period is selected. The steps may then be repeated, as indicated with arrow 418. Below, a further sub-diagram 420 indicates photon flux from the X-ray tube in the vertical direction and along time in the horizontal direction. In a row below, indicated with reference numeral 422, certain CT views are shown. Further below, a source flux sequence 424 is shown for the 100% flux period in an upper row 426, for a 10% flux period in a middle row 428, and for a 0% flux period in a lower row 430. In periods of sufficiently low photon flux, all incoming photons are detected per detector pixel. In case, the momentary detector signal should exceed the limit of a linear response of the detector pixel, those data which, were measured during the high flux period are ignored. Only the photon flux, which arrives during the low flux period, is valuated. This signal provides a sufficient large signal-to-noise-ratio, as the attenuation of the object is low in this setting. Modulation periods may be shorter than CT projection periods.

In another exemplary embodiment of the present invention, a computer program or a computer program element is provided that is characterized by being adapted to execute the method steps of the method according to one of the preceding embodiments, on an appropriate system.

The computer program element might therefore be stored on a computer unit, which might also be part of an embodiment of the present invention. This computing unit may be adapted to perform or induce a performing of the steps of the method described above. Moreover, it may be adapted to operate the components of the above described apparatus. The computing unit can be adapted to operate automatically and/or to execute the orders of a user. A computer program may be loaded into a working memory of a data processor. The data processor may thus be equipped to carry out the method of the invention.

This exemplary embodiment of the invention covers both, a computer program that right from the beginning uses the invention and a computer program that by means of an up-date turns an existing program into a program that uses the invention.

Further on, the computer program element might be able to provide all necessary steps to fulfill the procedure of an exemplary embodiment of the method as described above.

According to a further exemplary embodiment of the present invention, a computer readable medium, such as a CD-ROM, is presented wherein the computer readable medium has a computer program element stored on it which computer program element is described by the preceding section.

A computer program may be stored and/or distributed on a suitable medium, such as an optical storage medium or a solid state medium supplied together with or as part of other hardware, but may also be distributed in other forms, such as via the internet or other wired or wireless telecommunication systems.

However, the computer program may also be presented over a network like the World Wide Web and can be downloaded into the working memory of a data processor from such a network. According to a further exemplary embodiment of the present invention, a medium for making a computer program element available for downloading is provided, which computer program element is arranged to perform a method according to one of the previously described embodiments of the invention.

It has to be noted that embodiments of the invention are described with reference to different subject matters. In particular, some embodiments are described with reference to method type claims whereas other embodiments are described with reference to the device type claims. However, a person skilled in the art will gather from the above and the following description that, unless otherwise notified, in addition to any combination of features belonging to one type of subject matter also any combination between features relating to different subject matters is considered to be disclosed with this application. However, all features can be combined providing synergetic effects that are more than the simple summation of the features.

While the invention has been illustrated and described in detail in the drawings and foregoing description, such illustration and description are to be considered illustrative or exemplary and not restrictive. The invention is not limited to the disclosed embodiments. Other variations to the disclosed embodiments can be understood and effected by those skilled in the art in practicing a claimed invention, from a study of the drawings, the disclosure, and the dependent claims.

In the claims, the word "comprising" does not exclude other elements or steps, and the indefinite article "a" or "an" does not exclude a plurality. A single processor or other unit may fulfill the functions of several items re-cited in the claims. The mere fact that certain measures are re-cited in mutually different dependent claims does not indicate that a combination of these measures cannot be used to advantage. Any reference signs in the claims should not be construed as limiting the scope.

The invention claimed is:

1. An anode disk for a rotating anode in an X-ray tube for periodically modulating a generated X-ray beam, comprising a circumferential target area, the target area having:

a focal track including a plurality of alternating target surface positions and beam-dump surface positions;

wherein the target surface area is configured such that, when being hit by an electron beam, X-rays for X-ray imaging are generated;

wherein the beam-dump surface area is configured such that, when being hit by an electron beam, no useful X-rays for X-ray imaging are generated;

wherein the target portions and the beam-dump portions are arranged along a center line of the focal track such that a center of a focal spot, in which X-ray radiation is generated, is centered on the focal track center line;

wherein structures on both sides of the focal track center line are arranged such that same radiation intensities are generated on the both sides of the center line when being hit by a homogenous electron beam; and wherein the alternating target portions and beam-dump portions are disposed periodically along the focal track center line.

2. The anode disk according to claim 1, wherein the target portions are provided with different radial widths and/or with different radial lengths.

3. The anode disk according to claim 1, wherein the beam-dump portions are radially symmetric about the center line.

4. The anode disk according to claim 1, wherein at least a part of the target portions comprises first sub-portions and second sub-portions;

wherein the first sub-portions are provided with a first radial length; and the second sub-portions are provided with a second radial length; and wherein the first radial length is larger than the second radial length.

5. The anode disk according to claim 1, wherein at least a part of the target portions comprises first sub-portions and second sub-portions;

wherein the first sub-portions comprise target plateaus;

wherein the second sub-portions comprise transition plateaus adjacent to the first sub-portions; and wherein the transition plateaus have a decreasing radial width from the first sub-portion to the beam-dump portion.

6. An X-ray tube for generating periodic modulation of X-ray intensity, comprising:

a cathode;

the anode disk according to claim 1;

a tube housing with an X-ray window;

wherein the cathode is configured to emit electrons as an electron beam with a focal spot on the center line of the focal track; and wherein the beam-dumps are provided such that, in the position when being hit by the electron beam, a bottom surface of the beam-dump has no line-of-sight to the X-ray window.

7. The X-ray tube according to claim 6, further including a focusing means for shaping a size and form of the focal spot.

8. An X-ray imaging system, comprising:

the X-ray tube according to claim 6;

an X-ray detector configured to integrate received X-rays over an integration period; and a controller configured to control rotation of the anode such that a phase of anode rotation is synchronized with the integration period of the X-ray detector.

9. A method for modulating an X-ray beam, comprising the following steps:

a) radiating an electron beam towards a rotating anode comprising a circumferential target area, with a target surface area, a focal track center line, and a beam-dump surface area;

b) when the target surface area is hit by the electron beam, generating X-rays for X-ray imaging and when the beam-dump surface is hit by the electron beam, no useful X-rays for X-ray imaging are generated; wherein the target surface area comprises a plurality of target portions; and the beam-dump surface area comprises a plurality of beam-dump portions disposed periodically along the circumferential target surface area and radially symmetric relative to the focal track center line;

c) rotating the anode and focusing the electron beam on the focal track center line such that a center of a focal spot is located on the focal track center line; generating the modulated X-ray beam.

10. The method according to claim 9, wherein during step b), the electron beam is focused such that the focal spot assumes at least two different shapes varying radial length.

11. An X-ray tube for generating a periodically modulated X-ray beam, the X-ray tube comprising:

a cathode configured to emit electrons;

magnetic or capacitive focusing elements configured to focus the emitted electrodes into an electron beam of a selected cross-section;

a rotating anode disk including a circumferential focal track, the electron beam being focused onto a center line of the circumferential focal track in a focal spot whose cross-sectional dimensions are controlled by the focusing elements, a plurality of target surface portions configured to generate X-rays when hit by the X-ray beam and a plurality of beam-dump surface portions configured not to generate useful X-rays when hit by the electron beam, the target portions and the beam-dump portions being disposed alternately and periodically along the center line of the focal track such that as the anode disk rotates with the electron beam focused on the focal track center line, the X-ray beam is alternately and periodically generated and not generated, wherein the target surface portions are radially symmetric about the focal track center line.

12. The X-ray tube according to claim 11, wherein beam-dump portions have an increasing and decreasing radial width with two sides forming a radially outwards oriented opening angle, which opening angle is larger than a fan angle of an X-ray beam radiated through the X-ray window.

13. An X-ray tube including a rotating anode for generating a periodically modulated X-ray beam, the x-ray tube comprising:

an anode disk including a circumferential target area including:

a continuous target surface extending along a center line of the target area, the target surface being configured to generate X-rays in response to being struck by an electron beam;

a plurality of pairs of beam-dump surface areas periodically along the target area symmetrically on opposing sides of the center line of the target area;

a cathode configured to emit electrons;

a focusing means for focusing the electrons into a focal spot centered on the center line of the target area and for adjusting a size of the focal spot between a large size that strikes the continuous target surface and the beam dump surface areas such that the generated X-ray beam is modulated with a periodicity of the beam-dump areas and a small size that strikes only the continuous target surface such that the generated X-ray beam is not modulated.

* * * * *